United States Patent [19]

Kvarnegård

[11] 4,039,832

[45] Aug. 2, 1977

[54] APPARATUS FOR THERMOGRAPHIC DUPLICATION OF INFORMATION COMPRISING A CURVE OR CAM MEMBER FOR AXIAL MOVEMENT OF DYE CARRIER

[75] Inventor: Sven Bertil Kvarnegård, Enebyberg, Sweden

[73] Assignee: AB Carl Lamm, Stockholm, Sweden

[21] Appl. No.: 719,399

[22] Filed: Sept. 1, 1976

[30] Foreign Application Priority Data

Sept. 3, 1975 Sweden ..... 7509771

[51] Int. Cl.[2] ..... B41M 5/18; B41M 19/08

[52] U.S. Cl. ..... 250/318; 101/471

[58] Field of Search ..... 250/316, 318; 101/471

[56] References Cited

U.S. PATENT DOCUMENTS

| | | | |
|---|---|---|---|
| 3,414,724 | 12/1968 | Kvarnegård | 250/318 |
| 3,648,609 | 3/1972 | Ritzerfeld | 250/316 |

*Primary Examiner*—Alfred E. Smith
*Assistant Examiner*—T. N. Grigsby
*Attorney, Agent, or Firm*—Eyre, Mann, Lucas & Just

[57] ABSTRACT

An apparatus for duplicating information from a master provided with information, such as text lines or the like, comprising a drum rotatable in a stand, to which drum the master is applied, and the master during rotation of the drum is exposed to directed heat radiation from one or more heat radiators and supplied to a dye-carrier rotating synchronously with the drum, which carrier comprises a dye-carrying web, the dye of which adheres to the master in agreement with the information applied thereon, unprepared copy receiving sheets are then contacted with the master and subsequently removed therefrom. The dye-carrier is mounted nonrotatably but movably on a drive axle supported rotatably in the stand, the apparatus comprises a curve member changing in the direction of the drive axle, along which curve member a curve follower member runs at an angular speed in relation to the curve member equal to an entire division of the angular speed of the dye-carrier so that during one revolution of the dye-carrier it is moved on the drive axle from one position to another one. The invention permits the dye carrier to be used more than once.

6 Claims, 4 Drawing Figures

APPARATUS FOR THERMOGRAPHIC DUPLICATION OF INFORMATION COMPRISING A CURVE OR CAM MEMBER FOR AXIAL MOVEMENT OF DYE CARRIER

This invention relates to apparatuses for thermographically duplicating information applied to an original, particularly text information, according to the principle known, for example, through the Swedish patent specification 317,391 and Swedish patent application 7502769-8.

Information on the original, the master, which is applied to a drum rotating intermittently through one revolution at a time, is heated by means of an infrared radiator and moved against a dye carrier, whereby a dye composition due to the heat adheres to the master in the places corresponding to the information, whereafter the dye composition on the master again is heated by a second infrared radiator. The master thus provided with softened or molten dye composition finally is contacted to a copy receiving sheet. The process is repeated according to the number of copies required and is described in detail in said Swedish patent specification.

The invention has the object to provide an improved dye carrier for an apparatus of the above type.

At conventional dye carriers comprising a web of some kind of carrier material, for example paper, coated on one side with a dye composition which upon exposure to heat softens or melts, said web is given a speed corresponding to the circumferential speed of the drum and is advanced through a distance corresponding to the entire length of the copy receiving sheet in the circumferential direction of the drum for each revolution of the drum. Disregarding a relatively complicated feed device comprising acceleration and braking means, for each revolution of the drum a web length is consumed which at least is equal to the "circumferential length" of the master. In view of the fact, that in the places corresponding to information on the master not all of the dye is transferred to the master, and that the information, for example in the case of text information, usually occupies totally seen a small area of the pattern, it is easily understood that the dominating part of the web with the dye composition remains intact and unused. This is not desirable, in view of the relative expensiveness of these dye carriers.

The dye carrier according to the invention comprised in the apparatus permits each running length of the web with its dye composition be used several times.

This is achieved thereby that the invention shows the characterizing features defined in the attached claims.

At experiments it was found suitable to use the web up to ten times without deterioration of the quality of the copies.

Figure 1:
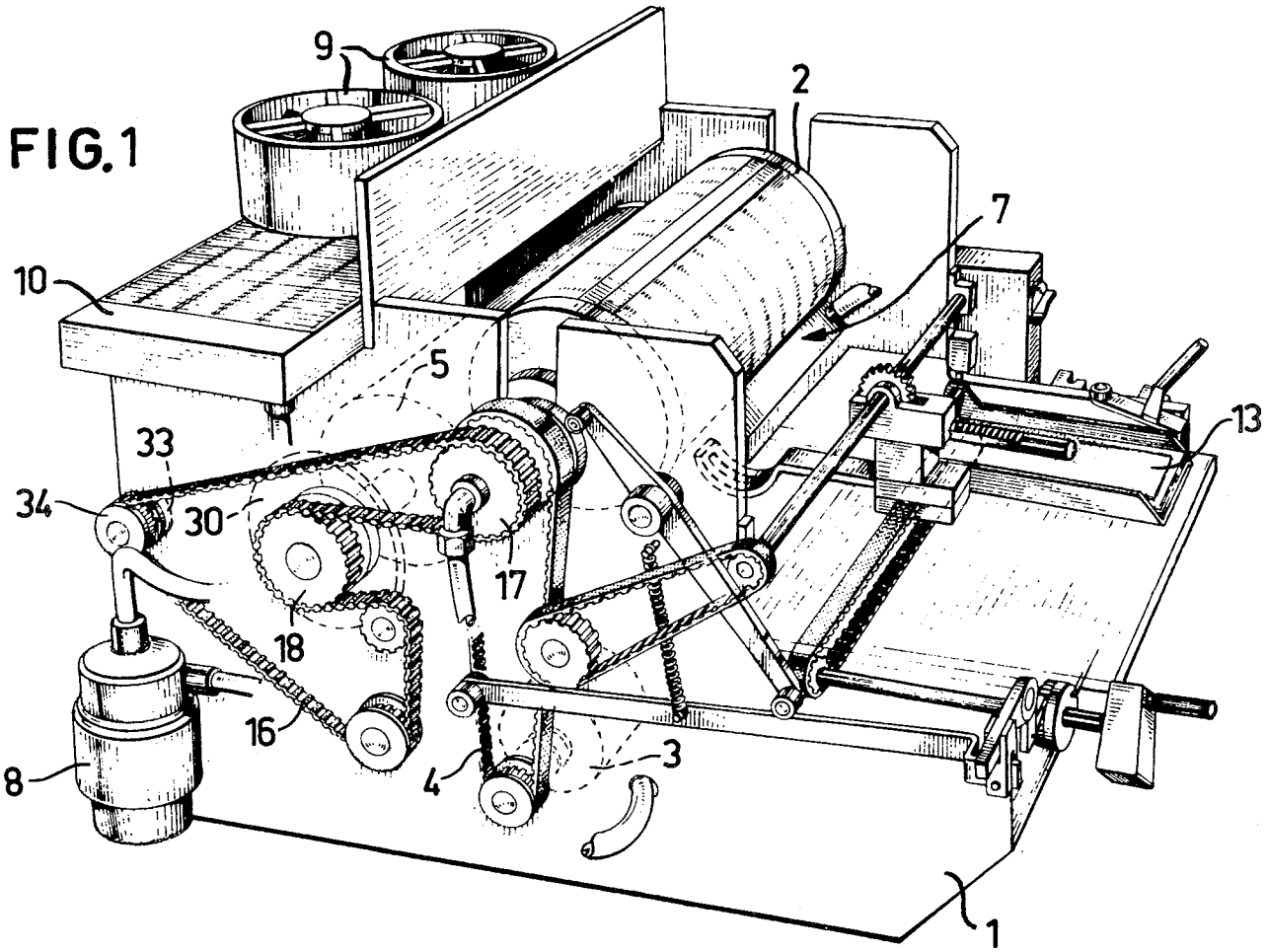
Figure 2:
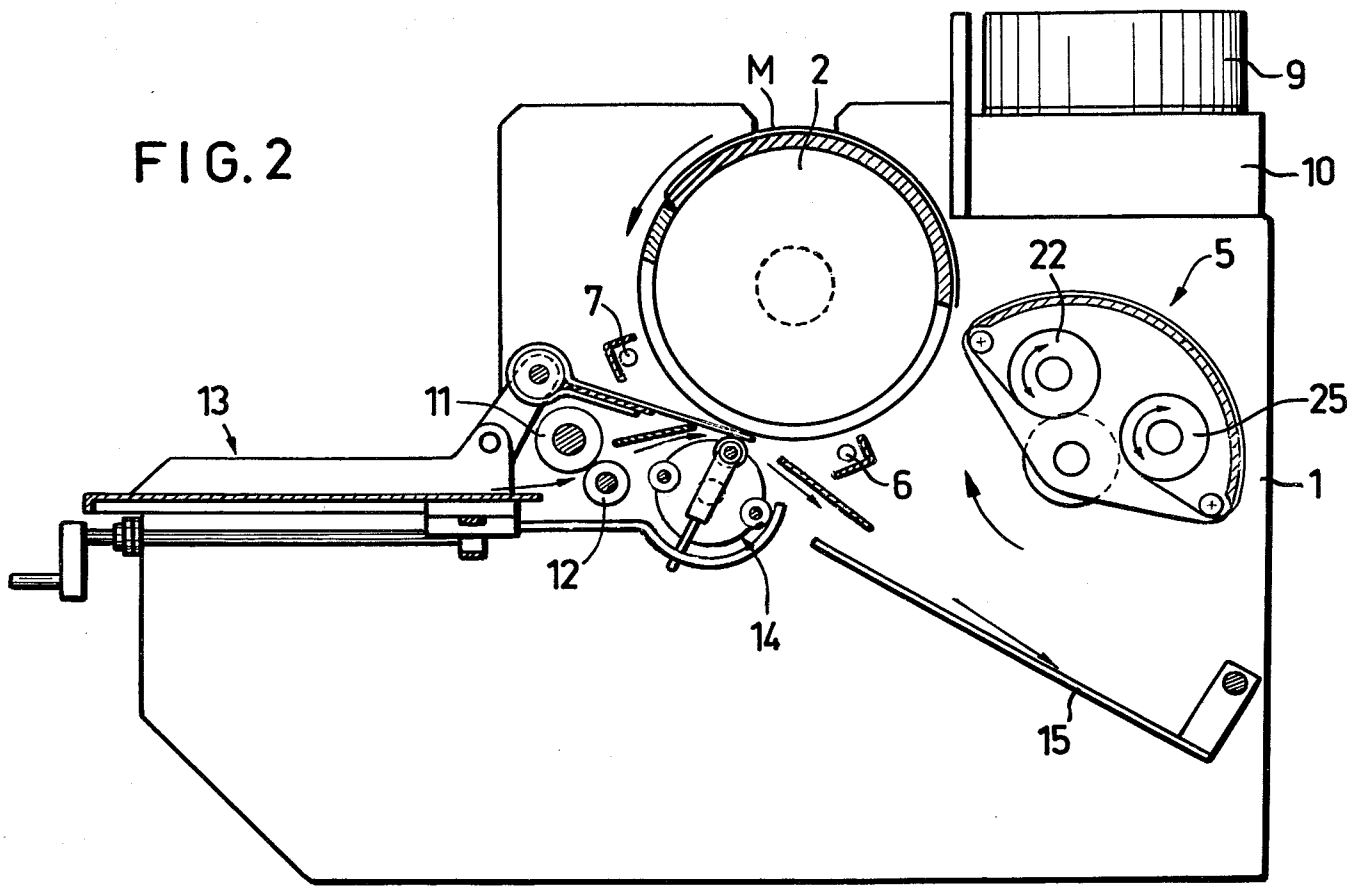
Figure 3:
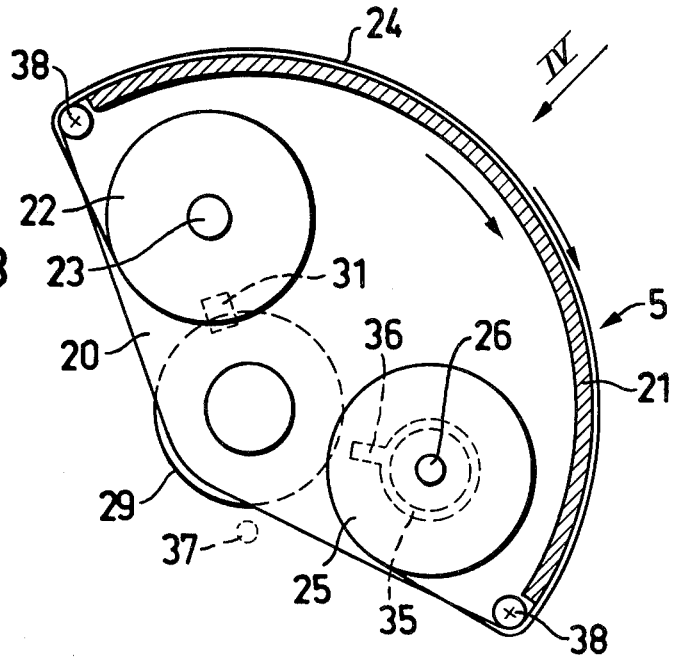
Figure 4:
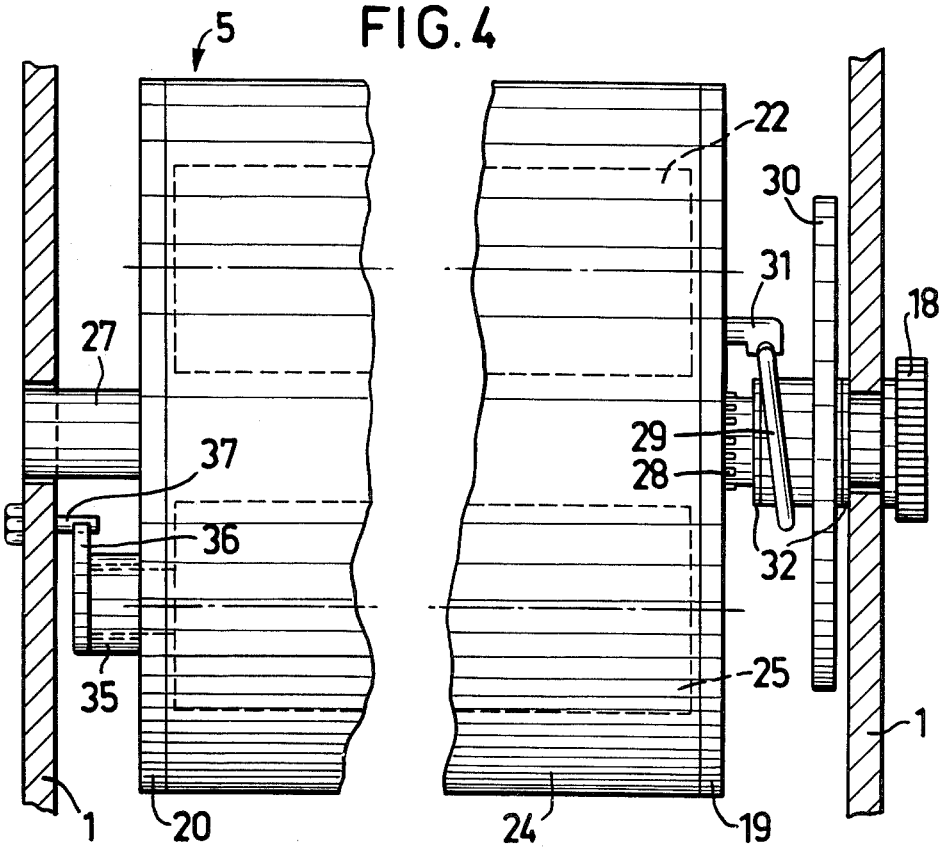

The invention is described in greater detail in the following by way of an embodiment thereof, with reference to the accompanying drawings, in which FIG. 1 is a perspective view of the entire apparatus, partially broken up, FIG. 2 is a schematic section seen from the side of the apparatus shown in FIG. 1, FIG. 3 is a cross-section of the dye carrier, and FIG. 4 is a schematic view of the dye carrier according to FIG. 3 seen in the direction of the arrow IV, the central portion being cut away. The apparatus shown schematically in FIG. 1 comprises a casing 1, in which a drum 2 is rotatably mounted and in conventional manner driven by a motor 3 via a toothed belt 4. The drum is designed so as in known manner be able to carry an original document or master facing with the information toward the drum. A dye carrier, shown schematically at 5, is provided to act against the drum 2 and therewith the master. The apparatus further is provided with two radiation sources 6, 7 of known type, which are cooled by a liquid pumped by a pump 8 past the radiation sources and cooled in a cooler 10 exposed to the air of fans 9. The apparatus further comprises a pair of co-operating feed rollers 11, 12 for feeding a copy receiving sheet lying on a table 13 to a pressure roller unit 14 comprising pressure rollers selectively applicable against the drum. The copy receiving sheets provided with information from the master are discharged to a guide plate 15 for continued handling. The principle of the thermographic duplication is per se well known and, therefore, not explained in greater detail, but reference is made, for example, to said Swedish patent specification 317,391 and said Swedish patent application 7502769-8.

The dye carrier 5 shown schematically in FIG. 1, is rotated synchronously with the drum 2 by means of a toothed belt 16, which runs over wheels 17 and 18 attached to the axle of the drum 2 and, respectively, dye carrier 5. The ratio between the gear wheels 17 and 18 and, respectively, the diameters of the drum and dye carrier must be adapted so that a non-slipping contact of the web against the drum 2 is obtained while the dye composition is being transferred from the web to the copy receiving sheet, i. e. during the rotation of the dye carrier 5 and its rolling-off against the drum 2.

The dye carrier 5 comprises two end wall pieces 19 and 20 and a partially cylindric shield 21 interconnecting said pieces. Between the end wall pieces 19 and 20 and inside of the shield 21 a magazine roll 22 is supported on an axle 23. Said magazine roll 22 consists of a reeled unused web 24 coated with dye. Said web 24, as appears from FIGS. 2 and 3, runs over the shield 21 with the dye-coated surface turned outward and is wound on a winding roll 25, which is supported inside of the shield 21 in the end wall pieces by means of an axle 26. The dye carrier 5 is supported in the rotation centre of the partially cylindric shield non-rotatably but axially movably on an axle 27. This is indicated in FIG. 4 by a spline connection 28.

The axle 27, on which the dye carrier 5 is supported, in its turn is mounted rotatably in the stand 1 and is provided at its and extending outside beyond the stand with the gear wheel 18. The dye carrier, thus, will participate in the rotation of the drum 2.

Freely rotatably about the axle 27 and between the stand 1 and the end wall piece 19, a curve or cam member 29 is arranged which is provided with a gear wheel 30. A curve follower member 31 fixed to the end wall piece 19 engages with the curve surface of the curve member 29. The curve member is prevented from moving axially on the axle 27, for example by means of stop rings or the like fixed on the axle as indicated at 32 FIG. 4. The gear wheel 30 is connected via a gear (not shown) to a gear wheel 33, which is non-rotatably connected to the gear wheel 34 mounted in the stand 1 and driven by the toothed belt 16 (FIG. 1). The cam member has such a ratio and direction of drive that for each entire revolution of the dye carrier 5 the cam member 29 will be turned through half a revolution. For every second revolution of the drum 2, and therewith of the dye carrier 5, said carrier will be located/moved to a left-hand end position, and for every second revolution to a right-hand end position. The cam member 29 must have such a shape or extension that an axial movement of the dye carrier must not take place during the time the carrier with web 24 lying idle on the shield 21 rolls against the drum 2.

The axle 26 of the winding roll 25 extends with one end through the end wall piece 20 and is supported thereon in a rotation locking device 35 of a conventional known kind. The winding roll 25, thus, can be turned only in one direction, seen in FIG. 3 in clockwise direction. The axle 26 further is connected with a shoulder 36, and in the stand 1 a pin 37 is fastened.

Upon rotation of the dye carrier 5, the shoulder 36 engages with the stationary pin 37 whereby the shoulder 36, and therewith the axle 26, are forced to rotate through such a distance that the shoulder 36 disengages from the pin 37. The dye-carrying web 24 thereby is advanced to a corresponding degree and wound onto the winding roll 25.

At each of the axial edges of the partially cylindrical shield 21, futhermore, a conducting roller 38 is provided, as schematically shown in FIGS. 2 and 3, which facilitate the turning of the web around the edge and reduce the friction.

The magazine roll 22 preferably is provided with a slip brake (not shown) to prevent unintentional unwinding of the web.

The operation, as easily can be understood, is as follows: When the drum 2 with the master M applied thereon is turned by the motor 3 through one revolution, also the dye carrier 5 will be turned through one revolution by means of the toothed belt 16. By the same toothed belt and via the gear between the gear wheels 33 and 30, the curve member 29 simultaneously is turned through half a revolution in the same direction as the dye carrier. While the dye carrier 5 is being turned and before the shield 21 with the web 24 lying thereon will contact the drum 2, the shoulder 36 engages with the pin 37 and advances the web 24 a distance ny winding the web onto the winding roll 25. When the dye carrier 5 with the web lying idle thereon rolls against the drum 2, thus, the web is advanced a certain distance, and the dye carrier is located in an end position on the axle 27. At the next revolution when the dye carrier with the web rolls against the drum, a new portion of the web has been additionally advanced, and the dye carrier is located in the opposed end position on the axle 27.

It was at experiments found suitable to dimension the axial movement of the dye carrier 5 with the magnitude of half a line distance 15, 36 and the feed of the dye-carrying web 24 with the magnitude of 21 mm in the the case when preferably text lines of A-4 size are to be duplicated. Hereby, at the state of inertia each "running meter" of the web will be used ten times. Each portion of the dye-carrying web corresponding to the text lines, thus, is utilized five times.

The invention described above, of course, can be modified within the scope of the attached claims and the capability of the expert. The ratio for the curve member may be a different one, i.e. the dye carrier can assume more than two positions upon its rolling against the drum, and it also is possible to advance the web only every second or third revolution, depending on the paper size, available dye composition etc. It further is possible, differently from the embodiment shown, to arrange the stepped feed of the web so that the feed all the time is of equal size, irrespective of the growth of the winding roll. The curve member may be attached to the end wall piece, and the curve follower member may be rotatable about the axle of the dye carrier.

What I claim is:

1. An apparatus for duplicating information from a master (M) provided with information, such as text lines or the like, comprising a drum rotatable in a stand, to which drum the master (M) with information thereon is applied, and the master (M) during rotation of the drum is exposed to directed heat radiation from one or more heat radiators and supplied to a dye-carrier rotating synchronously with the drum, which carrier comprises a dye-carrying web, the dye of which adheres to the master (M) agreement with the information applied thereon, whereafter unprepared copy receiving sheets are contacted with the master (M) and thereafter removed therefrom, characterized in that the dye-carrier is mounted non-rotatably in the stand, that it comprises a curve member changing in the direction of the drive axle, along which curve member a curve follower member runs at an angular speed in relation to the curve member equal to an entire division of the angular speed of the dye-carrier in order during one revolution of the dye-carrier to move the same on the drive axle from one position to another one, and a rotation locking device is provided to advance the dye-carrying web in co-operation with the stand upon rotation of the dye-carrier.

2. An apparatus according to claim 1, characterized in that the curve member is rotatable about the drive axle, and the curve follower is attached to the dye-carrier.

3. An apparatus according to claim 2, characterized in that the curve member is capable to rotate at half the angular speed of the dye-carrier.

4. An apparatus according to claim 1, characterized in that the dye-carrier consists of a magazine roll, onto which the dye-carrying web is wound, a web receiving winding roll and a partially cylindric shield between the rolls and supporting a part of the web, which shield about its central axle is rotatably supported by the end wall pieces carrying the rolls, which end pieces are non-rotatably but movably arranged on the drive axle.

5. An apparatus according to claim 4, characterized in that the rotation locking device is provided at the axle of the winding roll with a driving shoulder turning said axle and co-operating with a pin stationary on the apparatus.

6. An apparatus according to claim 4, characterized in that the magazine roll is provided with a slip brake.

* * * * *

UNITED STATES PATENT AND TRADEMARK OFFICE

CERTIFICATE OF CORRECTION

PATENT NO. : 4,039,832

DATED : August 2, 1977

INVENTOR(S) : Sven Bertil Kvarnegard

It is certified that error appears in the above-identified patent and that said Letters Patent are hereby corrected as shown below:

Col. 2, Line 50: "and" should read --end--

Col. 4, Line 25: (Claim 1): "in" omitted before "agreement"

Col. 4, Line 29: (Claim 1): Should read --is mounted non-rotatably but movably on a drive axle supported rotatably in the stand, that it comprises--

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*